US007610650B2

(12) United States Patent
Imao et al.

(10) Patent No.: US 7,610,650 B2
(45) Date of Patent: Nov. 3, 2009

(54) VEHICLE FOR CLEANING

(75) Inventors: Shunichi Imao, Tokyo (JP); Toshihiko Aoki, Tokyo (JP); Akihiko Kosugi, Tokyo (JP); Yukio Ilzuka, Shiga-ken (JP)

(73) Assignee: Sumco Corporation, Tokyo (JP)

( * ) Notice: Subject to any disclaimer, the term of this patent is extended or adjusted under 35 U.S.C. 154(b) by 477 days.

(21) Appl. No.: 11/327,437

(22) Filed: Jan. 9, 2006

(65) Prior Publication Data

US 2007/0157421 A1 Jul. 12, 2007

(51) Int. Cl.
*E01H 1/08* (2006.01)

(52) U.S. Cl. ..... 15/340.1; 15/347; 15/352

(58) Field of Classification Search ..... 15/340.1, 15/340.3, 347, 352, 353
See application file for complete search history.

(56) References Cited

U.S. PATENT DOCUMENTS 3,798,704 A * 3/1974 Kilstrom et al. ..... 15/319
4,554,701 A * 11/1985 Van Raaij ..... 15/347
4,570,287 A * 2/1986 Kerschner et al. ..... 15/346
4,938,239 A * 7/1990 Theurer et al. ..... 134/21
5,276,940 A * 1/1994 Renaudin ..... 15/345
5,553,349 A * 9/1996 Kilstrom et al. ..... 15/360

FOREIGN PATENT DOCUMENTS

JP 11-100120 4/1999
JP 2005081947 A * 3/2005

OTHER PUBLICATIONS

English Language Abstract of JP 11-100120.

* cited by examiner

*Primary Examiner*—Dung Van Nguyen
(74) *Attorney, Agent, or Firm*—Greenblum & Bernstein, P.L.C.

(57) ABSTRACT

A cleaning vehicle provided with driving wheels for traveling on a rail having a trench-shaped driving space provided on the floor for cleaning the rail, wherein a vehicle body is provided with an air drawer formed by providing a filter to an air outlet hole, a tip end portion of a drawing hose connected to the air drawer is provided with an air drawing member having an opening on the bottom of the rail, an air outlet is formed on the wall of a box-shaped body covering the entire air drawer, and an air cleaning unit is provided to the air outlet.

7 Claims, 2 Drawing Sheets

VEHICLE FOR CLEANING

BACKGROUND OF THE INVENTION

1. Field of the Invention

The present invention relates to a cleaning vehicle for cleaning a rail, for example, for a conveying vehicle to travel installed in a clean room.

2. Description of the Related Art

In places, such as a hospital, required to keep a clean air at a high degree (cleanliness degree), conveying vehicles are used for automatically conveying articles. As such conveying vehicles, there is an overhead traveling type having an advantage of not interfering with other operations (for example, refer to the patent article 1: The Japanese Patent Publication No. 11-100120).

Such an overhead traveling type conveying vehicle is configured that a reloading device of articles is provided to the vehicle body having wheels to run on the rails provided on the ceiling and also an air cleaning device is provided on the vehicle body side close to a wheel drive for preventing dusts generated on contact portions of the wheels from diffusing.

The conveying vehicle disclosed in the patent article 1 is installed in a hospital and configured that an air-cleaning device is provided on the vehicle body side close to the drive, that is, the configuration is just simple that an air around the drive is drawn by a fan and filtered.

A clean room for production of a semiconductor substrate, etc. is also provided with a conveying vehicle as explained above. When the conveying vehicle runs on the floor, rails are provided also on the floor and dusts arise at contact portions of the running wheels and accumulate on the rails. In such a clean room, there is a disadvantage that a sufficient cleanliness degree cannot be obtained just by introducing an air to a filter by a fan.

SUMMARY OF THE INVENTION

An object of the present invention is to provide a cleaning vehicle capable of attaining a higher cleanliness degree when cleaning rails for conveying vehicles to travel in a clean room.

To attain the above object, according to the present invention, there is provided a cleaning vehicle for cleaning a guide member having a trench-shaped driving space provided on the floor, comprising:

a vehicle body;

wheels provided to the vehicle body, for traveling in the guide member;

an air drawer provided to the vehicle body and provided with a dust removal member at its air exhausting portion;

an air drawing member provided at a tip end portion of an air drawing tube connected to the air drawer and having an opening on the bottom of the guide member;

a box-shaped body covering the entire air drawer and having an air outlet formed on the wall; and an air cleaning unit provided at the air outlet of the box-shaped body.

Furthermore, in the cleaning vehicle according to the present invention, the front and rear rim portions of the opening of the air drawing member are provided with a brush member for preventing dusts accumulated on the bottom of the guide member from moving outside of the opening.

According to the configuration of the cleaning vehicles explained above, as a result that dusts in the guide member are drawn by an air drawer and an air cleaned by a dust removal member provided at the air exhaustion portion is furthermore cleaned by an air cleaning unit provided to the box-shaped body, dusts in the guide member can be surely removed and an air exhausted by the cleaning vehicle includes almost no dusts. Therefore, the cleanliness degree in the clean room can be maintained very high.

Note that description in claims, a specification and drawings in the Japanese Unexamined Patent Publication No. 2003-314859 filed on Sep. 8, 2003 in Japan is referred to in the present invention and it is a part of description of the present invention.

BRIEF DESCRIPTION OF DRAWINGS

Below, a cleaning vehicle according to an embodiment of the present invention will be explained based on drawings.

DESCRIPTION OF THE PREFERRED EMBODIMENT

A cleaning vehicle according to the present embodiment will be explained based on FIG. 1 and FIG. 2.

For example, a production line of a semiconductor substrate, such as a wafer, is provided in a clean room so as to produce in a state that a high cleanliness degree is maintained, and moving of a semiconductor substrate is performed by an automatic conveying vehicle between respective production steps.

The conveying vehicle has wheels for traveling on thin rails, and a linear driving method (linear motor) for generating a thrust by cooperation of a pole piece arranged on the bottom of the rails and a coil arranged on the bottom of the vehicle body is applied therein.

The cleaning vehicle according to the present embodiment is for removing dusts accumulated on the rails and will be explained based on FIG. 1 and FIG. 2.

First, a rail (guide member) 1 shown in FIG. 1 will be explained. A section thereof has a rectangular shape and a space 2 for driving is formed at the center.

Namely, the rail 1 is composed of a bottom portion 1*a*, right and left sidewall portions 1*b* and an upper wall portion 1*c* having a slit (notched portion) 3 formed at the center along the traveling course. On the bottom portion 1*a*, portions close to the both sidewall portions 1*b* serve as driving surfaces for wheels (which will be explained later on), and a linear drive, that is, a pole piece 4 composing the linear motor is arranged in a trench portion formed at the center of the bottom portion 1*a*.

Next, a cleaning vehicle 11 running by the linear drive and guided by the rail 1 for removing dusts accumulated on the rail 1 explained above will be explained.

Figure 1:
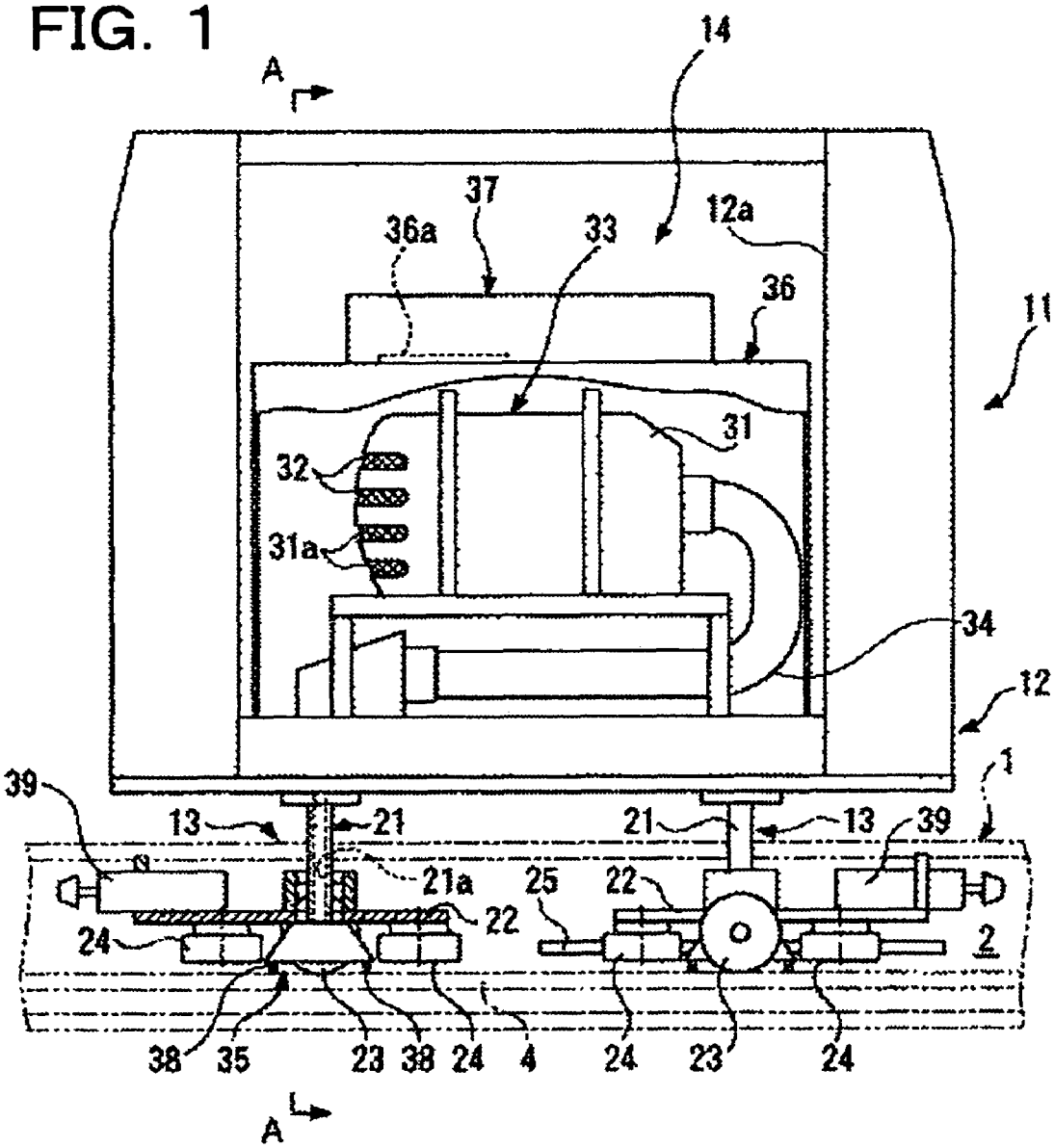
FIG. 1 is a view from the side of a cleaning vehicle according to an embodiment of the present invention.
Figure 2:
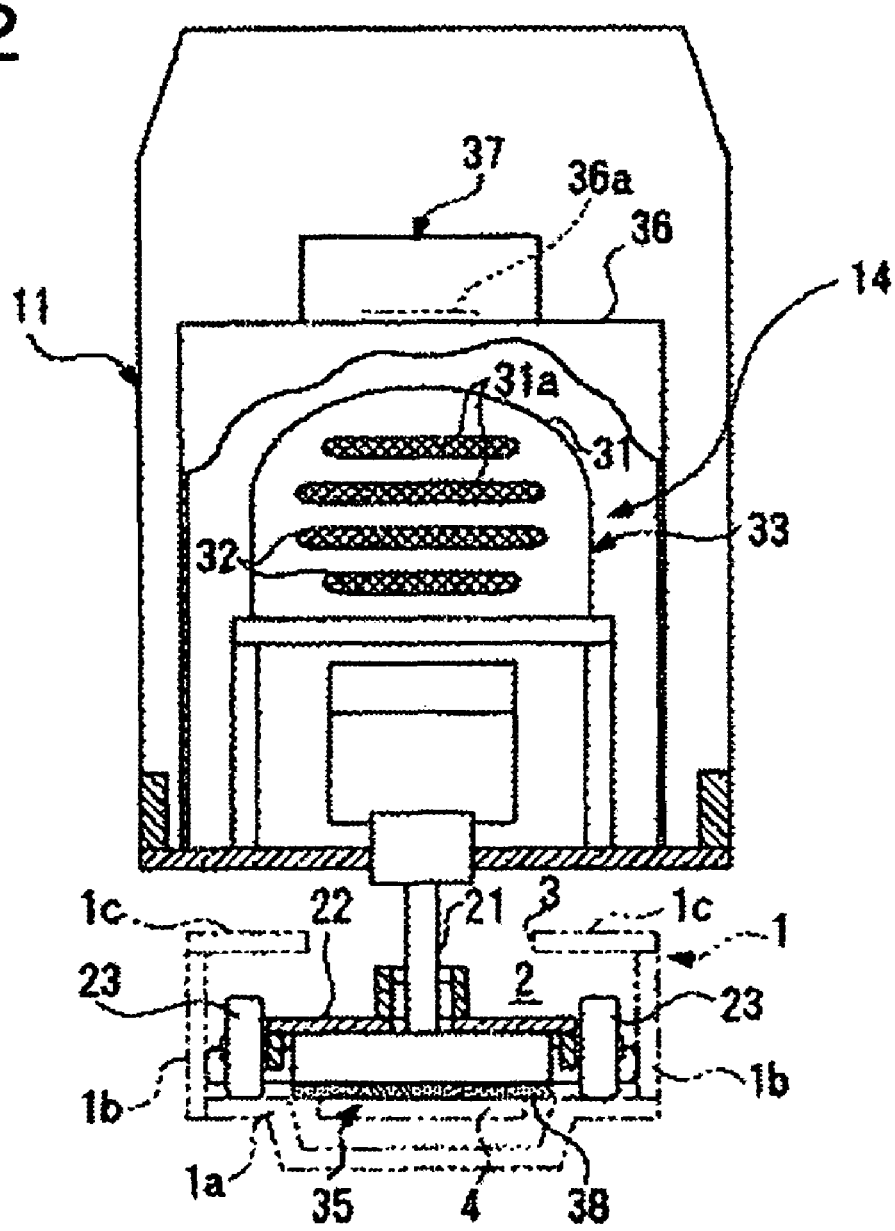
FIG. 2 is a sectional view along a line A-A in FIG. 1.

The cleaning vehicle 11 roughly comprises, as shown in FIG. 1 and FIG. 2, a vehicle body 12 provided with a device housing space 12*a*, a pair of driving portions 13 suspending from the front and the rear positions of the lower surface of the vehicle body 12, and a cleaning device 14 also provided to the vehicle body 12 for cleaning the rail 1.

To explain the driving portion 13, it is identical with that in the conveying vehicle and composed of support axis bodies 21 suspending respectively from the front and rear portions of the lower surface of the vehicle body 12, horizontal support plates 22 attached to lower end portions of the support axis bodies 21, driving wheels provided to both sides of a midpoint of each of the horizontal support plates 22 and each rotatable about a horizontal axis center, and side guiding wheels 24 provided on both sides at the front and rear portions of the horizontal support plates 22 and each rotatable about a vertical axis center. Between the horizontal support plates 22 of either of the front ones and the rear ones, a coil (primary coil) 25 for linear driving is arranged and, when a current is applied to the coil 25 and a magnetic flux generated thereby changes over time in the running direction, a thrust to drive the vehicle body 12 forward is generated by the coil together with the pole pieces 4 arranged on the floor.

Next, the cleaning device 14 will be explained.

The cleaning device 14 comprises an air drawer 33 arranged in the housing space 12*a* and configured by a casing 31 having a plurality of air outlets (air exhausting portion) 31*a* at its end portion and filters (dust removal members) 32 at the air outlets 31*a*, a drawing hose (flexible drawing tube) 34 with its one end (base end portion) connected to an air drawing inlet of the air drawer 33, an air drawing member arranged at the lower portion of the vehicle body 12 connected to the other end portion (tip end portion) of the drawing hose, for example, via a hollow portion 21*a* formed in the support axis body 21 (of course, it may be directly connected to the tip end of the drawing hose without the hollow portion of the support axis), a box-shaped body (also called a surrounding body) covering the entire air drawer 33 and having an air outlet 36*a* formed on the upper wall portion, and an air cleaning unit 37 provided on the upper wall portion of the box-shaped body 36 for cleaning air exhausted from the air outlet 36*a*. For example, the air-cleaning unit 37 includes an integrally formed air drawer and a filter (dust removal member) for removing dusts from air drawn by the air drawer.

Also, an opening (inlet) of the air drawing member 35 is formed to have a rectangular section being long in the width direction of the rail 1 when cut horizontally, the lengthwise section has a trapezoidal shape (trumpet or bugle shape), by which the front and rear walls become apart at the lower part, and a brush member (for example, using synthetic fiber brush) 38 is provided for preventing dusts accumulated on the bottom of the rail 1 from dispersing to outside of the opening as much as possible and for keeping the air drawing force. Note that, in FIG. 1, the reference number 39 indicates bumpers provided at the front and rear portions of the vehicle body 12 for preventing collision with other vehicles (of course, a detection function for detecting contact with other vehicle may be provided).

In the above configuration, when a normal conveying vehicle travels, dusts accumulate on the rail 1, but when the cleaning vehicle 11 travels, for example, regularly, the dusts accumulated on the rail 1 are removed.

Below, a cleaning operation by the cleaning vehicle 11 will be explained.

First, after moving conveying vehicles to outside of the traveling course (of course, cleaning can be done while conveying vehicles travel), the cleaning vehicle 11 is brought to be on the rail 1 as the traveling course.

Next, the cleaning vehicle 11 is brought to travel by the linear drive by applying a current to the coil 25 in a state that the air drawer 33 and air-cleaning unit 37 are in operation.

Then, dusts accumulated on the rail 1 are drawn from the opening of the air-drawing member 35 to the air drawer 33 through the drawing hose 34, and most of the dusts are collected and removed by the filters 32 provided to the air exhaustion holes 31*a*, so that a clean air is exhausted into the box-shaped body 36.

Then, the air exhausted into the box-shaped body 36 enters the air-cleaning unit 37 from the air outlet 36*a* to be furthermore cleaned, and the cleanliness degree of the air is furthermore improved. When the cleaning of the rail 1 completes, the cleaning vehicle 11 is removed from the rail 1 and collected dusts in the air drawer 33 and the air-cleaning unit 37 are disposed.

As explained above, dust on the rail 1 are drawn by the air drawer 33, an air cleaned by the filters 32 provided to the casing 31 is exhausted into the box-shaped body 36, and the exhausted air is furthermore cleaned by the air cleaning unit 37, so that even if dusts having a very small particle diameter remains albeit only slightly in the air exhausted from the air drawer 33, they can be removed almost completely.

Namely, when removing dusts on the rail 1 by drawing, the air exhausted from the cleaning device includes almost no dusts, so that the cleanliness degree in the clean room can be maintained very high.

In the above embodiment, the brush member 38 was provided at the front and rear rim portions of the opening of the air drawing member 35 but, for example, the brush member may be provided also at right and left rim portions to improve the air drawing force. Furthermore, density of the brush member provided at least at the front rim portion may be made lower than that of others so as to easily introduce dusts in front to the air-drawing member 35 side.

The embodiment explained above is for easier understanding of the present invention and not to limit the present invention. Accordingly, respective elements disclosed in the above embodiments include all modifications in designs and equivalents belonging to the technical field of the present invention.

What is claimed is:

1. A cleaning vehicle for cleaning a guide member having a trench-shaped driving space provided on the floor, comprising:

a vehicle body;

wheels provided to said vehicle body, for traveling along the guide member;

a support axis body interconnecting said vehicle body and one of said wheels and defining a hollow portion extending between said vehicle body and said one wheel;

an air drawer provided to said vehicle body and provided with a dust removal member at its air exhausting portion;

an air drawing tube extending between said air drawer and said support axis body;

an air drawing member provided at an end portion of said support axis body and having an opening adjacent to the guide member and being fluidly interconnected with said dust removal member via said hollow portion of said support axis body and said air drawing tube;

a box-shaped body covering said air drawer and having an air outlet on an upper wall; and an air cleaning unit provided on the upper wall of said box-shaped body and configured to clean air exhausted from said air outlet.

2. The cleaning vehicle as set forth in claim 1, wherein the opening of said air drawing member has a rectangular section being long in the width direction of the guide member when cut horizontally, and the axial section has a trapezoidal shape, by which the front and rear walls become apart at the lower part.

3. The cleaning vehicle as set forth in claim 2, wherein the front and rear rim portions of the opening of said air drawing member are provided with a brush member for preventing dusts accumulated on the bottom of the guide member from moving to outside of the opening.

4. The cleaning vehicle as set forth in claim 1, wherein the front and rear rim portions of the opening of said air drawing member are provided with a brush member for preventing dusts accumulated on the bottom of the guide member from moving to outside of the opening.

5. The cleaning vehicle as set forth in claim 4, wherein a density of said brush member provided at said front rim portion is less than a density of said brush member provided at said rear rim portion.

6. The cleaning vehicle as set forth in claim 1, wherein said air drawing member has front, rear, right, and left rim portions for defining said opening, and wherein each of said rim portions is provided with a brush member.

7. The cleaning vehicle as set forth in claim 6, wherein a density of said brush member provided at said front rim portion is less than a density of said brush member provided at said rear rim portion.

* * * * *